United States Patent [19]

Gaiser et al.

[11] 4,098,545

[45] Jul. 4, 1978

[54] ARRANGEMENT FOR PREVENTING MOISTURE BLISTER OF ORGANIC COATING ON IMPERMEABLE SUBSTRATES

[75] Inventors: Eugene F. Gaiser, Kettering; Norman W. James, Jr., Dayton, both of Ohio

[73] Assignee: General Motors Corporation, Detroit, Mich.

[21] Appl. No.: 711,428

[22] Filed: Aug. 4, 1976

[51] Int. Cl.[2] ..... A47B 81/00

[52] U.S. Cl. ..... 312/214; 134/201

[58] Field of Search ..... 29/460; 312/214; 427/287; 134/182, 201

[56] References Cited

U.S. PATENT DOCUMENTS

| | | | |
|---|---|---|---|
| 2,237,535 | 4/1941 | Wahl | 29/460 X |
| 3,277,042 | 10/1966 | Richart | 134/201 X |
| 3,289,293 | 12/1966 | Stenquist et al. | 29/460 X |
| 3,295,541 | 1/1967 | Ummel | 134/182 |

OTHER PUBLICATIONS 2,405,385 08001975 DEX 312 214

*Primary Examiner*—Paul R. Gilliam
*Assistant Examiner*—David H. Corbin
*Attorney, Agent, or Firm*—Frederick M. Ritchie

[57] ABSTRACT

The method of maintaining the adherence of a permeable organic coating to a wall of a dishwasher which is exposed to water, water vapor or dilute aqueous solutions at temperatures higher than surrounding ambient by reducing or eliminating the formation of blisters between said coating and said wall and comprising the steps of selectively insulating the side of said wall exposed to ambient in those areas of greatest thermal gradient where blisters are most likely to form in the absence of such insulation, and sufficiently insulating said side of said wall in such areas that the temperature gradient across said coating is reduced to the point that the partial pressure difference driving force of the vapor across said coating is negligible and not more than the adhesion forces of said coating to said wall.

1 Claim, 7 Drawing Figures

ARRANGEMENT FOR PREVENTING MOISTURE BLISTER OF ORGANIC COATING ON IMPERMEABLE SUBSTRATES

This invention relates to a method of preventing moisture blisters of organic coatings on impermeable substrates in dishwashers.

BACKGROUND OF THE INVENTION

While no unusual blister problem exists in many conventional uses of organic coatings, some potential uses have been considered unlikely because of coating performance. Porcelain enamel, stainless steel, and plastic are the materials generally specified for such uses. In these potential uses, some articles might be coated satisfactorily if the blister resistance of the coating were to be improved. Such articles are the outer tank or water container for clothes washers, bathtubs, vanity bowls, and dishwasher interiors, i.e., surfaces in contact with hot liquids or vapors. Heretofore, efforts to develop a satisfactory organic coating system for dishwasher interiors have been directed toward developing metal preparations and coatings which, in combination, will give adequate blister resistance in this application through better adhesion.

SUMMARY OF THE INVENTION

First, we found that thermal gradient has an effect on blister formation. Then we discovered the benefit of adding heat insulation, selectively, to reduce the thermal gradient and thereby prevent moisture blistering. It is significant that the blister prevention afforded by the insulation is extended to those surfaces exposed to vapor as well as the surfaces in contact with liquid.

In development and testing of organic coatings, humidity exposure is almost universally used, and the importance of condensation is accepted and is a requisite of many specifications. What has not been recognized before is the realization that liquid blisters between a coating and an impermeable substrate result from adhesion failure of the coating, and the forces which exceed the adhesion in these areas are differences in liquid vapor pressure across the coating. These differences may be caused by soluble solutes, or by temperature gradients, or both. Thus, the force which causes a liquid blister is caused by the magnitude of the vapor pressure difference of that liquid across the coating.

Even with improved adhesion between coatings and substrate, selective insulation would be desirable as an extra measure of protection to offset any inherent weakness occasioned by nonoptimum substrate pretreatment, coating application, care condition, or coating formulation.

Now, insulation in the prior art has been used for sound deadening or for minimizing heat loss. It has also been used to guard against the delamination of coatings caused by thermal expansion and contraction differences between substrate and coating, rather than by liquid segregation at the interface.

Some prior art suggests, as the cause of blisters, that liquid is transported through the film by liquid permeation to form the blister. Such art, however, does not make obvious the blistering effect of the difference in saturated vapor pressure across the film caused by the thermal gradient, nor the relationship of vapor pressure gradient and temperature gradient. We recognize that vapor pressure-temperature relationships are not linear and have found a much greater vapor pressure difference to exist between two different temperatures at a higher temperature range than exists between two more greatly different temperatures at a lower temperature range.

In paint and coating applications where the coating film is supported on an impermeable substrate and where the substrate side is at a lower temperature than the coating side, a temperature gradient exists across the coating. If the vapor pressure on the surface of the coating is greater than the saturation vapor pressure at the temperature of the substrate interface, and if the adhesion or bond of the coating to the substrate is not complete or is weak with respect to the forces created by the water vapor partial pressure difference, then vapor migration will result in condensation and blister formation between the coating and the substrate.

Moisture blistering of coatings on impermeable substrates can, therefore, occur as a result of the unfavorable combination of temperature difference across the film, the relative humidity at the face of the films, and the strength and completeness by which the film is bonded to the substrate.

By comparing saturated water vapor pressure data for different temperature ranges, we have found that small temperature gradients are responsible for increasingly greater vapor pressure differences in higher temperature ranges and consequently much greater forces are then exerted at the bond interface. For example, the vapor pressure difference for water between 37.8° C. and 38° C. (100° F.) is 0.535 mm. of mercury; between 60° C. and 60.2° C. (150° F.), the difference is 1.32 mm. of mercury; between 93° C. and 93.2° C. (200° F.), the difference increases to 4.40 mm. of mercury, or more than eight times the force on the bond structure as at 38° C. (100° F.) — the most frequently used temperature for humidity test evaluation of coatings. The strength and completeness by which a coating is bonded to a particular substrate can, therefore, be measured relative to its resistance to blistering when exposed to the proper thermal and humidity gradient.

The coating applications where this mode of premature blister failure is most frequently encountered are:

1. Coatings for surfaces which are exposed to water, water vapor, or dilute aqueous solutions under conditions which permit heat to be conducted through the coating to a lower temperature level.
2. Areas of such above surfaces where heat is caused to be conducted or transferred away or, in effect, cooled at a faster rate such as by exterior attachments, heavy sections and lap or welded seams.
3. Areas of such surfaces listed in items 1 or 2 above where the insulation effect of excessive coating thickness results in an increased thermal gradient across the coating film.

Accordingly, for dishwashing chambers where temperature differences exist across the coating, it is an object of this invention to provide a method of selective insulation for reducing the magnitude of the vapor pressure difference to a level below the adhesion level of the coating, thereby preventing blister formation.

Another object is the provision of a method of preventing blister formation by reducing the temperature difference or gradient across the permeable film comprising the step of adding insulation to certain portions of the back or cooler side of the impermeable substrate until the adhesion forces of the coating balance or exceed the lessened partial pressure difference driving force of the water vapor.

Further objects and advantages of the present invention will be apparent from the following description, reference being had to the accompanying drawings wherein a preferred embodiment of the present invention is clearly shown.

DESCRIPTION OF THE PREFERRED EMBODIMENT

Figure 1:
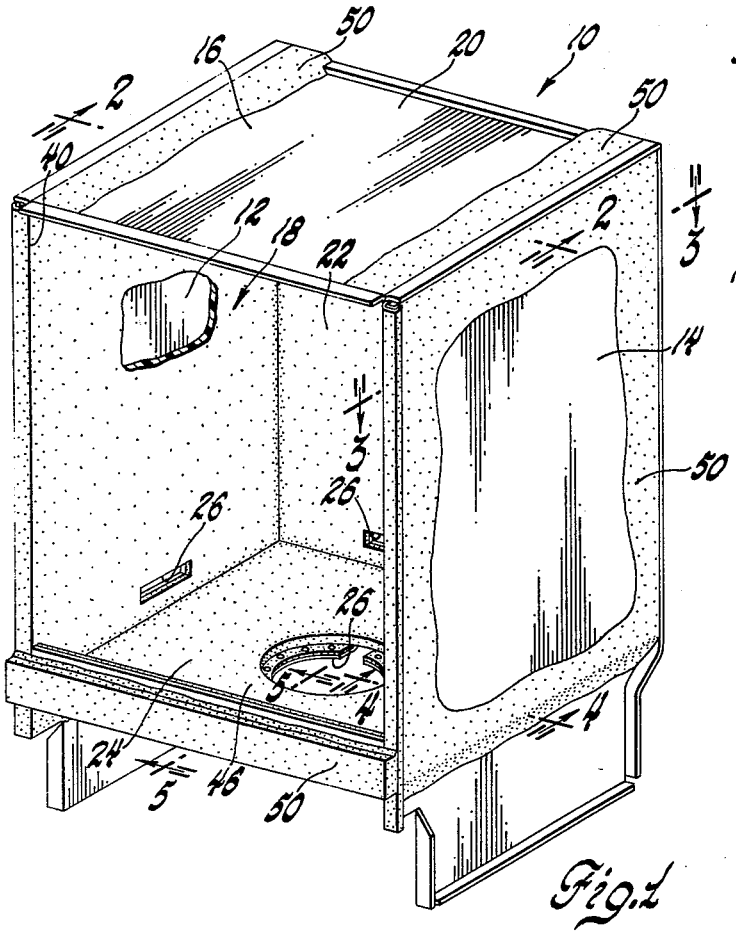
FIG. 1 is a perspective view of a dishwashing chamber prepared in accordance with the method of this invention.
Figure 2:
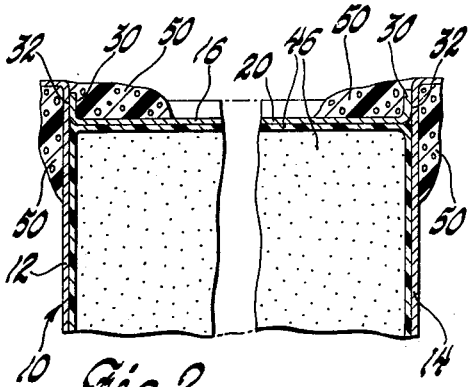
FIG. 2 is a section taken along line 2—2 of FIG. 1.

With reference to FIG. 1, a liner-tub 10 is shown which is adapted in accordance with this invention for inclusion as the dishwashing chamber forming member of a dishwasher. Liner-tub 10 is formed primarily from three panels of impermeable sheet metal 12, 14 and 16. Panels 12 and 14 form the sidewalls of a dishwashing chamber 18. Panel 16 is bent into C-shape to form the top wall 20, back wall 22, and bottom wall 24 of the dishwashing chamber. The panels may be provided with cutouts 26 for receiving various other components during final assembly of the dishwasher.

Dishwashing chamber 18 is formed by spot welding panels 12 and 14 to panel 16. In particular, panel 16 is provided with welding flanges 30 at each side thereof. These flanges abut panels 12 and 14 along three sides thereof to form jointures 32 where the walls of the liner-tub meet in the dishwashing chamber. The panels are spot welded together along each jointure 32.

Figure 3:
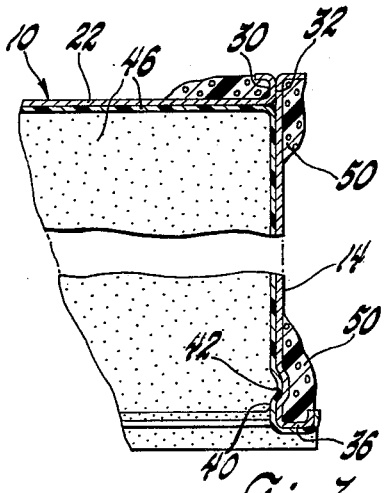
FIG. 3 is a section taken along line 3—3 of FIG. 1.
Figure 4:
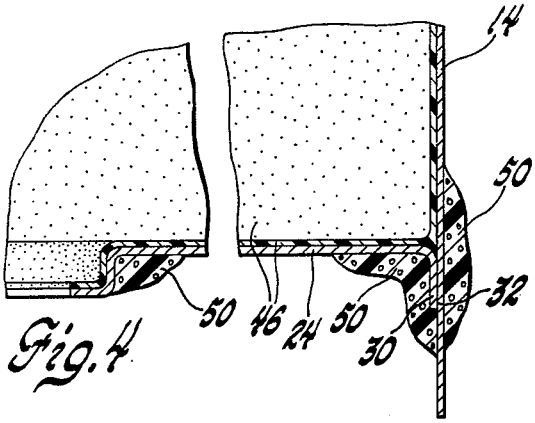
FIG. 4 is a section taken along line 4—4 of FIG. 1.
Figure 5:
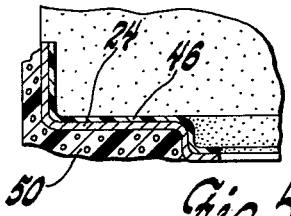
FIG. 5 is a section taken along line 5—5 of FIG. 1.

The front of each sidewall is formed with a channel 36 (FIG. 3) to define each side of an access opening 40 to the dishwashing chamber. Channel 36 may be configured with a recess 42 to receive a door seal during final assembly of the dishwasher.

After the liner-tub 10 is welded together, it is ready for coating the interior thereof. Conventional procedures may be used to preheat, prime and spray the interior surfaces of the dishwashing chamber with plastisol or other organic material to form a coating or layer 46 adhering to the interior surface of the liner-tub 10.

In the past, thermal gradients have caused blistering of the organic coating 46 along the jointures 32 formed by the spot welded flanges. Organic coatings evidencing such blistering have been acrylics, epoxys, polyesters and plastisols. Blistering has also occurred around the access opening and at locations where brackets or the like have been welded to the exterior surface of the dishwashing chamber. We have found that insulating the outside of the chamber in those locations where blistering has occured on the inside is a most effective way to prevent such blistering. We prefer a sprayed or foamed in place layer of urethane insulation 50 having a resultant thickness of substantially ⅛ inch to one inch. In mass production, we would most likely use a fire retardant spray which could sufficiently insulate those exterior locations tending to blister interiorly.

Sufficiently insulate means to provide an insulation layer on the outside which will reduce the temperature gradient across the organic coating on the inside to the point that the partial pressure difference driving force of the vapor across the coating is negligible and not more than the adhesion forces of said coating to the interior surface of the liner-tub 10.

Figure 6:
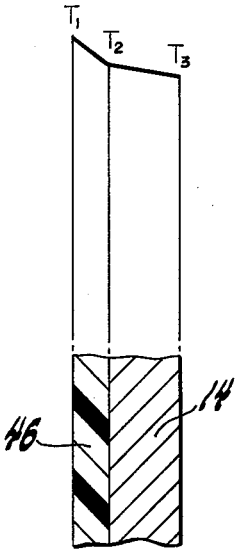
FIG. 6 is a graphical representation of the thermal gradient across the coating of an operating dishwasher without selective insulation of this invention.
Figure 7:
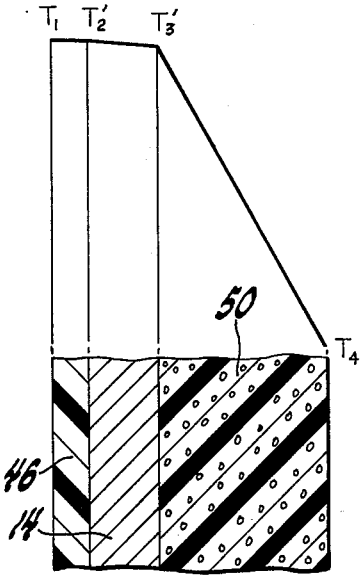
FIG. 7 is a graphical representation of the thermal gradient across the coating of an operating dishwasher with insulation selectively added to the exterior of the dishwasher in accordance with the teaching of this invention.

A graphical representation of the thermal gradient across the organic coating 46 would look like FIG. 6 without insulation and like FIG. 7 with added insulation 50. Comparing FIG. 6 with FIG. 7 shows $T_1 - T_2$ is greater than $T_1 - T_2'$ where $T_1$ is the temperature on the inside of the dishwashing chamber during operation of the dishwasher, $T_2$ is the temperature at the interface of the coating and interior surface of the sheet metal wall, $T_3$ is the temperature of the exterior surface of the sheet metal wall, and $T_4$ is the temperature of the exterior surface of the added insulation 50. $T_2'$ and $T_3'$ are the interior and exterior interface temperatures of a sheet metal wall provided with our invention.

While the embodiment of the present invention as herein disclosed constitutes a preferred form, it is to be understood that other forms might be adopted.

What is claimed is:

1. A dishwasher having a dishwashing chamber formed by a plurality of impermeable metal walls connected by welds along the jointures therebetween, each wall having one side thereof exposed to atmosphere and an opposite side facing toward the interior of said dishwashing chamber, a permeable organic coating such as acrylics, epoxys, polyesters and plastisols adhering to said opposite side, said coating being adapted for exposure to water, water vapor or dilute aqueous solutions at temperatures higher than said atmosphere, a layer of insulation such as urethane or the like selectively insulating said one side of said wall exposed to atmosphere and completely covering only those areas adjacent said jointures to a sufficient thickness that the temperature gradient across said coating is reduced to the point that the partial pressure difference driving force of the vapor across said coating is negligible and not more than the adhesion forces of said coating to said wall, thereby to reduce or eliminate the formation of blisters between said coating and said wall at said jointure.

* * * * *

UNITED STATES PATENT AND TRADEMARK OFFICE

CERTIFICATE OF CORRECTION

PATENT NO. : 4,098,545

DATED : July 4, 1978

INVENTOR(S) : Eugene F. Gaiser and Norman W. James, Jr.

It is certified that error appears in the above-identified patent and that said Letters Patent are hereby corrected as shown below:

Column 3, line 50, delete "preheat" and insert -- pretreat --.

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*